United States Patent [19]

Song

[11] 4,252,863

[45] Feb. 24, 1981

[54] VIOLIN STRUCTURE AND PROCESS

[76] Inventor: Hwehyun Song, 4204 Brentwood La., Waukegan, Ill. 60085

[21] Appl. No.: 93,192

[22] Filed: Nov. 13, 1979

[51] Int. Cl.[3] ..... G10D 1/02; B05D 3/12; B05D 3/02

[52] U.S. Cl. ..... 428/537; 84/275; 144/317; 144/327; 427/289; 427/317; 427/382; 427/401; 427/408; 428/540

[58] Field of Search ..... 427/289, 317, 223, 224, 427/440, 382, 325, 401, 408; 84/275; 144/317, 327; 428/537, 540

[56] References Cited

U.S. PATENT DOCUMENTS

| | | | |
|---|---|---|---|
| 72,877 | 12/1867 | May | 427/440 |
| 94,204 | 8/1869 | Heinemann | 427/440 |
| 1,483,733 | 2/1924 | Kozelek | 427/317 X |

FOREIGN PATENT DOCUMENTS

| | | | |
|---|---|---|---|
| 28729 | of 1905 | United Kingdom | 427/325 |

OTHER PUBLICATIONS

Oakes, W. W., *A Review of Ancient & Modern Violin Making,* pp. 20–27, 1899.

*Primary Examiner*—Michael R. Lusignan
*Attorney, Agent, or Firm*—Robert E. O'Neill

[57] ABSTRACT

An improved technique for making the finished shell of a violin. The wood used in the construction of a violin shell is subjected to a heating and treating process which improves the sound properties of the wood in a completed violin. The wood is first subjected to a temperature of 180° F. to 350° F. for a period of 1 to 2 months and then coated with iodine and again heated to a temperature of 300° for a period of 2 to 7 days until the wood becomes charcoal-like. The wood is then scraped and varnished to produce the finished shell of a violin.

10 Claims, No Drawings

VIOLIN STRUCTURE AND PROCESS

BACKGROUND OF THE INVENTION

The present invention relates to a technique for treating wood to improve its sonorous properties and more particularly, to a technique for forming the wood shell of a violin to improve the quality of sound produced by a finished violin.

It has long been thought that one of the secrets to successful violin making lies in the careful selection of the wood used for its construction. Many authorities believe that the wood grown in Germany, Austria and Northern Italy has superior tonal qualities which account for the quality of the voilins produced by those considered masters in the art of violin making. One theory is that the wood found in the above noted areas is old wood which is superior to that used by contemporary violin makers. Others believe that the old wood theory is without a sound basis and that the belief in the superior quality of old violins and violins constructed using old wood is somewhat of a myth perpetuated to increase the value of such violins. Whatever the theory, however, it is generally conceded that the wood is one of the most important factors in violin making and much investigation and experimentation has centered on developing techniques to improve the sound in the wood structure of a violin.

By way of example, in U.S. Pat. No. 72,877, there is disclosed a method of treating wood used in the construction of a variety of musical instruments in order to improve its sonorous quality. The patent teaches that in the preparation of wood for constructing pianos and violins, it is known to kiln-dry the wood so that it becomes very powerful and delicate in vibration. The patent notes, however, that the effects produced by kiln-drying are only temporary. Accordingly, the patent discloses a soaking and drying process which is alleged to impart an elastic quality to the treated wood, thereby improving the vibratory power in musical instruments.

In other instances, the prior art discourages any specific chemical or heat treatment of the wood. More particularly, one such publication entitled "How to Make Your Own Violin" by Leroy Geiger, published by Ernst Heinrich Roth Company Inc., 1963, clearly states that kiln-dried, baked or otherwise "treated" wood should be avoided in violin construction since such treatment injures the acoustical properties of the wood.

Whatever the beliefs may be, it is clear that the wood is considered to be an important part of violin construction. There is therefore a continuing need for new techniques and processes which improve the sound quality of the wood and violin so that contemporary violins may be considered to have sound qualities similar to that attributed to violins produced by the old masters such as Stradivarius.

SUMMARY OF THE INVENTION

There is disclosed a technique for improving the sound qualities of the wood used in the construction of a violin. The wood is cut and configured in a conventional manner for use in the formation of a violin shell including the top, back, sides, and neck. The wood is subjected to a temperature of 180° F. to 350° F. for a period of 1 to 2 months and then coated with iodine and again subjected to a temperature of 300° F. for a period of 2 to 7 days until the wood becomes charcoal-like. The wood is then scraped and varnished to produce the finished violin shell for use in forming a completed violin.

It is a feature of the present invention to provide a technique for improving the sound quality of wood for use in musical instruments.

It is a further feature of the invention to provide an inexpensive technique for constructing a violin with improved sound and appearance.

It is still another feature of the invention to provide a violin of improved sound and appearance without the use of old wood.

These and other advantages and novel features of the invention will become apparent from the following detailed description.

DETAILED DESCRIPTION OF A PREFERRED EMBODIMENT

Generally, the basic techniques, materials and structure of a violin are well known in the prior art. While there are a multitude of variations in the details of those known techniques and structures, the present invention is applicable to and compatible with substantially all such techniques. For purposes of this description, reference may be made to the previously noted publication "How To Make Your Own Violin" by Leroy Geiger, for one example of the techniques and materials used in making a violin.

In accordance with the present invention, the conventional violin construction techniques are modified by specially preparing the wood forming the shell or body of the violin. In one type of conventional violin, the shell of the violin is constructed using spruce as the wood forming the top or sound board of the violin and maple as the wood for the back, sides, and neck of the violin, although the present invention is not constructed to use any particular wood for specific parts. Pursuant to the present invention, the wood is cut and shaped in a conventional manner to form the parts of the violin and then subjected to a heating and treating process. While parts of the wood may be prepared and treated individually prior to assembly, it is preferred that the parts are assembled to form the violin structure prior to their preparation and treatment in accordance with the present technique. This prevents mismatching of woods, cracking and shrinkage due to uneven expansion and contraction and otherwise contributes to an improved overall appearance of the completed violin.

In any event, after the wood parts have been cut and formed to their desired shape and thickness, the wood is first subjected to heat treatment wherein the wood is subjected to a temperature of 180° F. to 350° F. for a period of 1 to 2 months. The purpose of the heating is to eliminate rosin particles which are contained in the wood and which are believed to decrease the quality of the sound when employed in a musical instrument. It has been found that if the wood is heated below 180°, the rosin particles are not effectively removed and, in addition, the wood tends to crack following heating. Likewise, if the wood is heated in excess of 350° F., the wood tends to crack after heating even though the rosin particles are removed very quickly. When the wood is heated between 180° F. and 350° F. over the 1 to 2 month period, however, the rosin particles appear to be effectively removed without subsequent cracking of the wood.

The specific length of time within the range of 1 to 2 months and the specific temperature within the range of 180° F. to 350° F. to which the wood should be subjected, may be varied for different types of woods and may be ascertained with minimal experimentation. However, it is desired that the time period and temperature be fixed within those ranges so that the wood becomes generally dark brown in color and light in weight prior to removal. It is also preferred that during the first day of heating during the specific period, the temperature be gradually increased from the 180° F. temperature to the selected upper limit within the range of 180° F. to 350° F. By way of example, for a violin shell utilizing a spruce top and maple back or bottom, sides, and neck, the temperature should be raised from 180° F. to 250° F. during the first day of heating and maintained at 250° F. for a period of about 2 months to achieve the desired results.

After the rosins have been substantially removed, the wood is next covered with a coating of iodine. The iodine can be that which may be normally purchased as a conventional antiseptic and does not have to be of any particular strength. However, the iodine is preferably diluted with equal parts of alcohol and applied to the wood so that it absorbs the iodine. The wood is then heated again to a temperature of about 300° F. for a period of from 2 to 7 days until the wood becomes black and charcoal-like. While the effect of using the iodine is not completely understood, it appears that the iodine in some way acts as a catalyst to charcoalize the wood. For a spruce and maple violin shell, it usually takes about 3 days at 300° F. to produce the desired effect. In addition, the iodine causes the wood to have sharp grain features which enhance the appearance of the violin.

After the wood has been heated for the 2 to 7 day period, the wood is removed and the surfaces are scraped, or otherwise reduced in thickness, to remove about 0.5 mm thickness of the wood. This removes the black charcoal-like surface caused by heating and brings out the grain structure of the wood produced by the iodine. After assembling to complete the violin, the wood is coated with multiple layers of a suitable well-drying varnish as a finishing material to complete the violin structure. If varnish is used, it must be chosen so that it is of a type which has an afterdrying hardness approximating the hardness of the wood, otherwise it will decrease the quality of the sound of the violin.

When the wood is prepared in accordance with the above technique, the completed violin has a quality of sound that is considered to be like that of the violins produced by the old masters. More specifically, the heating process has beneficial effects on the power, delicacy and tone of the sound produced by a violin constructed in accordance with this technique. The process allows the wood to be made thinner on the top and back of the violin, thereby increasing the power. The process also increases the sound conductance of the wood to improve the delicacy of the sound. Finally, the process of heating and varnishing improves the tone of the instrument. In addition, the wood grain features are enhanced by the iodine absorbed by the wood which causes the instrument to be more attractive and similar in appearance to those old violins considered to be of superior quality. All of these benefits can be provided to violins constructed with what is considered "new" wood, thereby eliminating the need for specially seasoned old wood. The instrument can thus be prepared inexpensively, yet provide a quality of sound and appearance that is usually only accorded to those old and famous violins of the masters.

While the invention has not been described with reference to a particular heating apparatus to perform the heating in the disclosed process, any conventional structure will suffice. The apparatus may be an oven, kiln or other device in which the wood is placed until the desired heating effects are achieved. However, it is important that the oven or heating apparatus used is of such construction that the wood is heated evenly and uniformly when placed therein. Obviously, many modifications and variations are possible in light of the above teachings. It is therefore to be understood that within the scope of the appended claims, the invention may be practiced otherwise than as specifically described.

I claim:

1. A process for preparing wood to improve its sound properties in musical instruments comprising:

subjecting the wood to a temperature in the range of 180° F. to 350° F. for a period of 1 to 2 months to remove rosins in the wood and until the wood becomes dark brown in color;

coating the darkened wood with iodine so that the iodine is absorbed into the wood;

subjecting the iodine coated wood to a temperature of 300° F. for a period of 2 to 7 days until the wood surfaces appear black and charcoal-like; and removing about 0.5 mm from the surface of the blackened wood.

2. In a process for making a violin wherein natural wood is shaped and formed into a configuration of a violin, the improvement in said process comprising:

subjecting said natural wood to a temperature substantially within the range of 180° F. to 350° F. for a period of 1 to 2 months until rosins in the wood are substantially removed and the wood becomes dark brown in color;

coating the darkened wood with iodine so that the iodine is absorbed into the wood;

subjecting the iodine coated wood to a temperature of about 300° F. for a period of 2 to 7 days until the wood surfaces appear black and charcoal-like;

removing approximately 0.5 mm from the surface of the blackened wood; and applying a finishing coating material to the wood surfaces to complete the violin.

3. The process of claim 2 wherein the step of subjecting said wood to a temperature within the range of 180° F. to 350° F. includes the step of gradually increasing the temperature on the first day of the period from 180° F. to a selected upper limit.

4. The process of claim 2 wherein the wood is selected so that the top of the violin is spruce and the bottom and sides of the violin are maple.

5. The process of claim 2 wherein the finishing material is a varnish selected to have an after-drying hardness approximating the hardness of the wood.

6. The process of claim 4 wherein the step of subjecting the wood to a temperature of 180° F. to 350° F. comprises the step of subjecting the wood to a temperature of 250° F. for a period of 2 months and said step of subjecting said coated wood to a temperature of 300° F. comprises subjecting said wood to a temperature of 300° F. for a period of 3 days.

7. In a violin constructed and shaped from natural wood, the improvement in said violin comprising:

subjecting said natural wood during construction of the violin to a temperature substantially within the range of 180° F. to 350° F. for a period of 1 to 2 months until rosins in the wood are substantially removed and the wood becomes dark brown in color;

coating the darkened wood with iodine so that the iodine is absorbed into the wood;

subjecting the iodine coated wood to a temperature of about 300° F. for a period of 2 to 7 days until the wood surfaces appear black and charcoal-like;

removing approximately 0.5 mm from the surface of the blackened wood; and applying a finishing material to the wood surfaces to complete the violin.

8. The violin of claim 7 wherein said finishing material is a varnish selected to have an after-drying hardness approximating the hardness of the wood.

9. The process of claim 2 further including the step of assembling the natural wood to form the violin structure prior to subjecting said natural wood to a temperature.

10. The violin of claim 7 wherein prior to subjecting said natural wood to a temperature, said natural wood is assembled to form the violin structure.

* * * * *